US006682033B1

(12) United States Patent
Cohen et al.

(10) Patent No.: US 6,682,033 B1
(45) Date of Patent: Jan. 27, 2004

(54) SUPPORT DEVICE FOR SUPPORTING FRAMES AND OTHER OBJECTS FROM A STRUCTURE

(76) Inventors: Mark Cohen, 134 Winterstein Dr., Folsom, CA (US) 95630; Robin Harter, 932 47th St., Sacramento, CA (US) 95819

( * ) Notice: Subject to any disclaimer, the term of this patent is extended or adjusted under 35 U.S.C. 154(b) by 0 days.

(21) Appl. No.: 10/211,056

(22) Filed: Aug. 1, 2002

(51) Int. Cl.[7] ..... A47B 96/06
(52) U.S. Cl. ..... 248/220.22
(58) Field of Search ..... 248/220.22, 216.1, 248/224.61, 217.3, 223.41

(56) References Cited

U.S. PATENT DOCUMENTS

| | | | | | |
|---|---|---|---|---|---|
| 3,871,121 | A | | 3/1975 | Tornell | |
| 4,179,089 | A | | 12/1979 | Parr, Jr. | |
| 4,279,087 | A | | 7/1981 | Crawford | |
| 4,428,135 | A | * | 1/1984 | Sobel | 40/782 |
| 4,850,125 | A | * | 7/1989 | Green | 40/737 |
| 5,138,780 | A | | 8/1992 | Kunkel | |
| 5,199,681 | A | | 4/1993 | Reidy | |
| 5,464,185 | A | | 11/1995 | Hensley | |
| 5,484,126 | A | * | 1/1996 | Kitchin | 248/217.3 |
| 5,588,629 | A | | 12/1996 | Barnes | |
| 6,042,078 | A | * | 3/2000 | Donovan | 248/547 |
| 6,065,236 | A | * | 5/2000 | Schneider | 40/757 |
| 6,126,126 | A | * | 10/2000 | McKiernan, Jr. | 248/217.3 |
| 6,186,466 | B1 | | 2/2001 | Baird et al. | |
| 6,279,862 | B1 | * | 8/2001 | Gershowitz | 248/216.1 |
| 2001/0047605 | A1 | * | 12/2001 | Schneider | 40/757 |
| 2002/0171017 | A1 | * | 11/2002 | McKeirnan et al. | 248/217.3 |

* cited by examiner

*Primary Examiner*—Leslie A. Braun
*Assistant Examiner*—Kofi Schulterbrandt
(74) *Attorney, Agent, or Firm*—Thomas R. Lampe

(57) ABSTRACT

A support device for supporting a frame or other object from a wall or other structure. The support device includes a support member placed in a recess of an object and releasably frictionally retained in place. At least one canted pin member projects from the support member for entering the structure.

9 Claims, 4 Drawing Sheets

SUPPORT DEVICE FOR SUPPORTING FRAMES AND OTHER OBJECTS FROM A STRUCTURE

TECHNICAL FIELD

This invention relates to a device which is particularly applicable to hang or support frames and other types of objects from cubicle walls and other types of walls. The invention is particularly useful when employed with fabric or other soft wall surfaces of the types commonly employed in office cubicles.

BACKGROUND OF THE INVENTION

People often encounter difficulties when attempting to hang frames and other types of objects from cubicle walls. Conventional hanger hardware is inappropriate and ineffective in such an environment.

A search directed to the present invention located the following United States Patents: U.S. Pat. No. 4,179,089, issued Dec. 18, 1979, U.S. Pat. No. 5,199,681, issued Apr. 16, 1993, U.S. Pat. No. 6,186,466, issued Feb. 13, 2001, U.S. Pat. No. 5,588,629, issued Dec. 31, 1996, U.S. Pat. No. 5,138,780, issued Aug. 18, 1992, U.S. Pat. No. 4,279,087, issued Jul. 21, 1981, U.S. Pat. No. 3,871,121, issued Mar. 18, 1975, and U.S. Pat. No. 5,464,185, issued Nov. 7, 1995.

The invention disclosed and claimed herein is not taught or suggested by the known prior art.

DISCLOSURE OF INVENTION

The present invention is directed to a support device for supporting an object from a wall or other structure. The support device is particularly useful for supporting frames and other types of objects from soft cubicle walls, corkboard, etc. The support provided is highly stable. The support device may readily be applied to or removed from a wall or other structure. The support device itself is characterized by its ease of use and effectiveness. Objects may be supported from soft cubicle walls by the support device without damaging the wall or permanently marking the wall. Repositioning of the support device is accomplished simply and quickly.

The support device of the present invention comprises a support member having a front support member surface and a rear support member surface. The rear support member surface is for positioning in face-to-face relationship with the wall or other structure.

At least one pin member is connected to the support member for piercing and entering the wall, the pin member projecting rearwardly from the rear support member surface. The at least one pin member is for maintaining the rear support surface in face-to-face relationship with the structure and for maintaining the support member at a desired location on the structure. The pin member is inclined downwardly and defines an acute angle with the rear support member surface.

The support member additionally has a pair of opposed object engagement surfaces extending between the front support member surface and the rear support member surface. One of the object engagement surfaces is an arcuate surface and the other of the object engagement surfaces defines an indent extending the length of the support member. The support member is for entering a recess defined by two spaced portions of the object and for releasable retention in the recess due to frictional engagement between the support member and the two spaced portions.

Other features, advantages and objects of the present invention will become apparent with reference to the following description and accompanying drawings.

MODES FOR CARRYING OUT THE INVENTION

Figure 1:
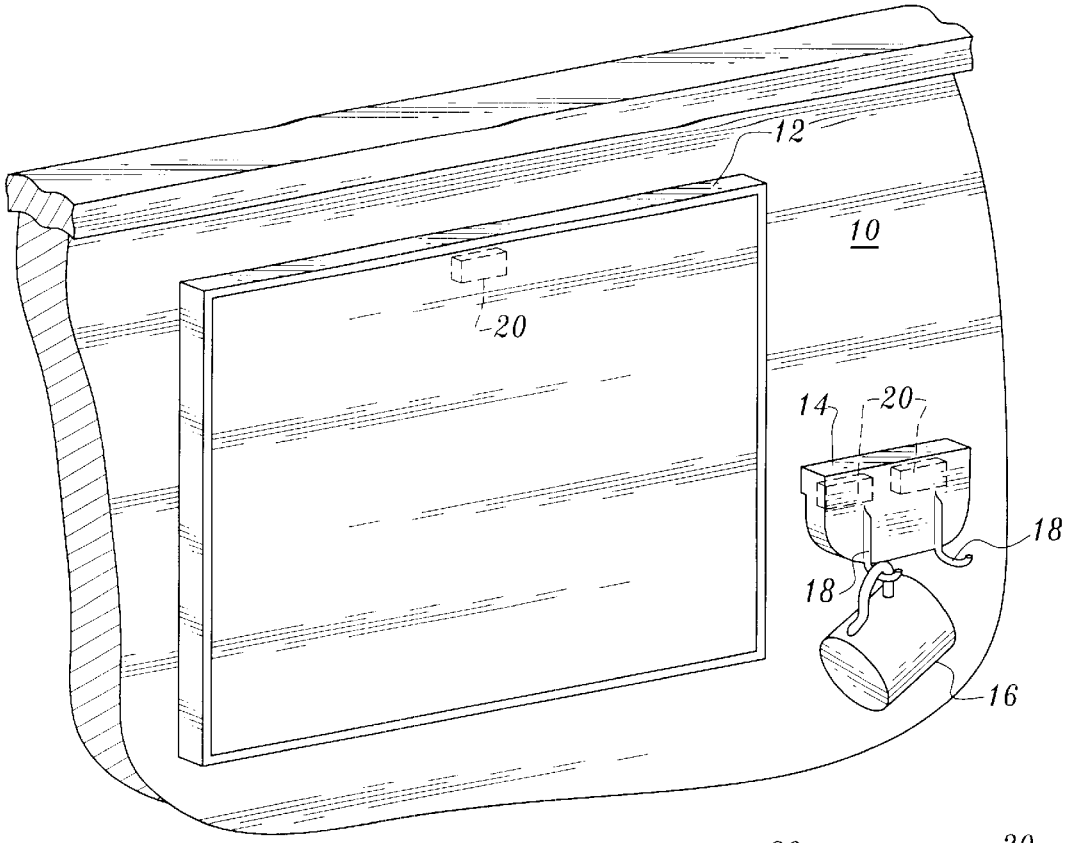
FIG. 1 is a perspective view illustrating a portion of a cubicle wall having two objects, a frame and a cup holder, supported by support devices constructed in accordance with the teachings of the present invention.
Figure 2:
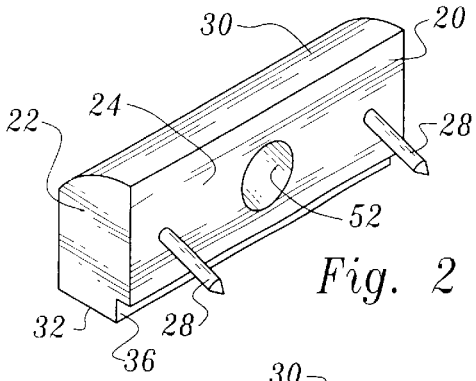
FIG. 2 is an enlarged, perspective view of a preferred form of the support device.

Referring now to FIG. 1, a soft cubicle wall 10 of conventional construction is shown. Typically such walls are comprised of an inner soft porous core and outer fabric surfaces. In FIG. 1 the wall 10 supports two objects, a picture frame 12 and a cup holder 14, the latter in turn holding a cup 16 from one of the hooks 18 of the cup holder.

A support device 20 is employed to support the frame from the cubicle wall. Two such support devices 20 are utilized to support the cup holder 14.

Referring now to FIGS. 2–7, the support device 20 includes a support member 22 of integral construction, preferably formed of plastic or the like. The support member is relatively rigid, suitably being a molded plastic part.

Support member 22 has a planar front support member surface 24 and a planar rear support member surface 26. The rear support member surface 26 is for positioning in face-to-face relationship with the wall 10.

Two spaced pin members 28 are affixed to the support member for piercing and entering the wall. The pin members project rearwardly from the rear support member surface for maintaining the rear support member surface in face-to-face relationship with the wall and for maintaining the support member at a desired location on the wall.

The pin members are parallel to one another and they are inclined downwardly to define an acute angle with the rear support member surface 26.

The support member 22 also has a pair of opposed object engagement surfaces 30, 32 which extend between the front and rear support member surfaces along the length of the support member.

Figure 4:
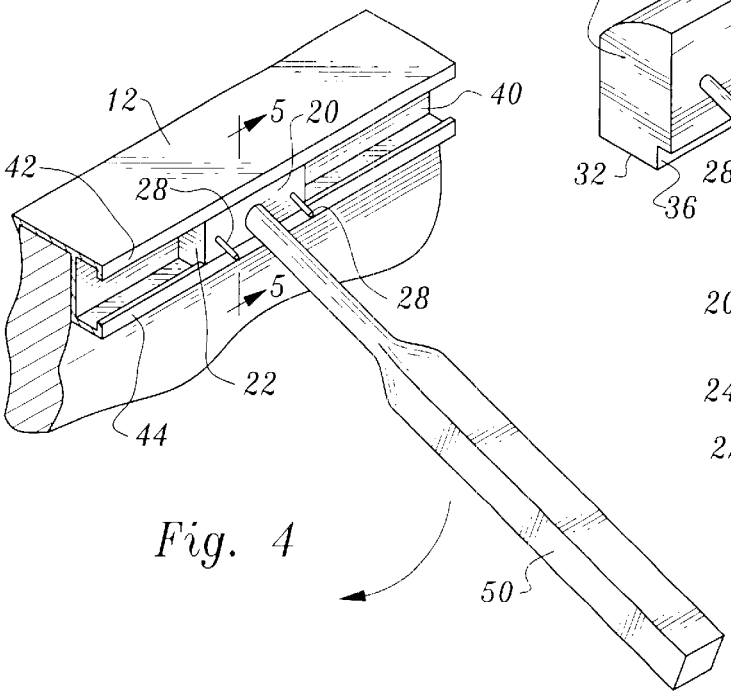
FIG. 4 is a perspective view illustrating the rear of a portion of a frame and a support device positioned in a recess of the frame, as well as a tool utilized to install the support device on a frame or remove the support device from the frame.
Figure 3:
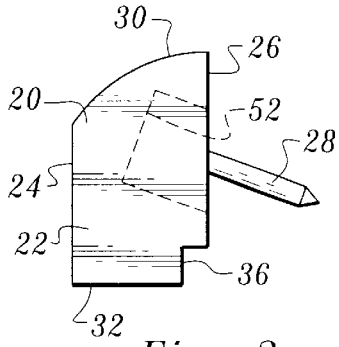
FIG. 3 is a side, elevational view of the support device.
Figure 5:
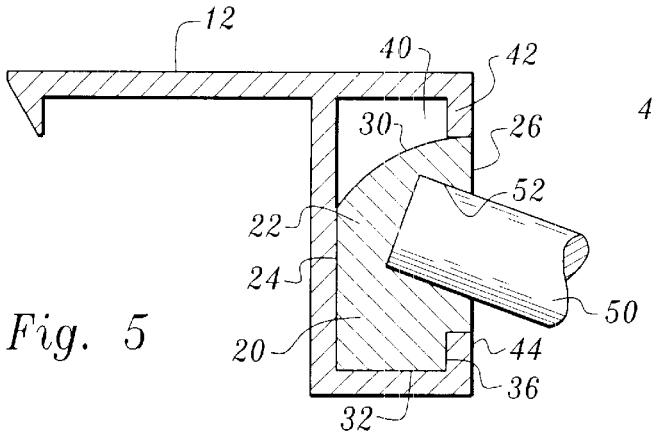
FIG. 5 is a greatly enlarged, sectional view taken along the line 5—5 in FIG. 4 showing the support device installed in the recess of a frame.
Figure 6:
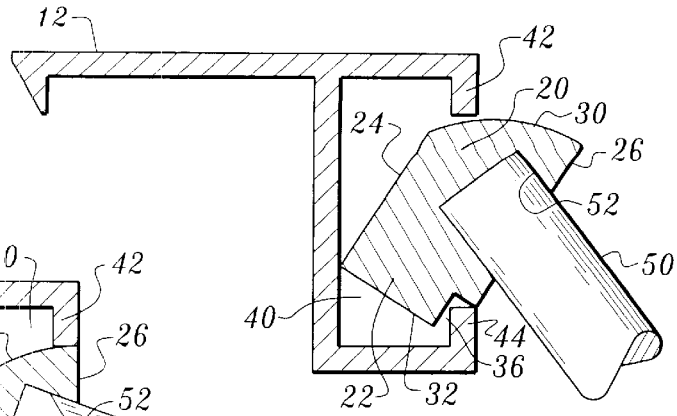
FIG. 6 is a view similar to FIG. 5, but showing the support device not completely in position in the recess.
Figure 7:
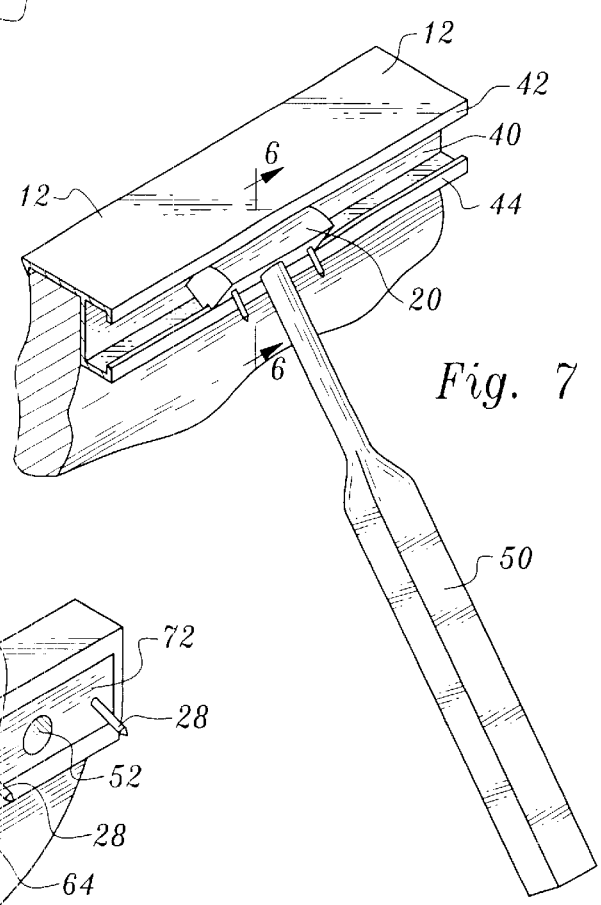
FIG. 7 is a view similar to FIG. 4, but showing the support device and related tool in the condition of FIG. 6.

In FIGS. 4 and 5, the support member is shown wholly positioned in a recess 40 defined by two spaced lips or frame portions 42, 44 at the back of frame 12. When the support member is in such position, the indent 36 receives the distal end of lip 44. The front support member surface member 24 is in engagement with the frame as is object engagement surface 32. The lip 42 is in engagement with the arcuate or curved surface 30 of the support member.

The support member is dimensioned such that tight frictional engagement exists between object engagement surface 30 and lip 42 and between lower object engagement surface 32 in the area of the indent and lip 44. This will enable the frame and support member to be of unitary construction so that the unit can be readily installed on a wall by piercing the wall with the pin members. Since the pin members are canted, gravity will ensure that they remain in the wall with the frame supported in a stable manner. Removal of the frame and support member from the wall is readily accomplished simply by lifting the unit and pulling it away from the wall.

In the embodiment under discussion, a hand-held tool 50 is employed to install the support member in the frame recess and to remove it therefrom. The support member 22 has a hole 52 formed therein which receives an end of the tool. To install the support device, the tool is manually manipulated to position lip 44 in indent 36 (see FIG. 6); then the tool is used to tilt the support device to the position shown in FIG. 5 wherein the support member is firmly frictionally engaged by the frame. The tool is removed from the support member. The support device is removed from the frame by the tool 50, when desired, simply by manipulating the tool to tilt it from the frictionally engaged, captured position of FIG. 5 to the position shown in FIG. 6 whereupon the support device is extracted.

Figure 8:
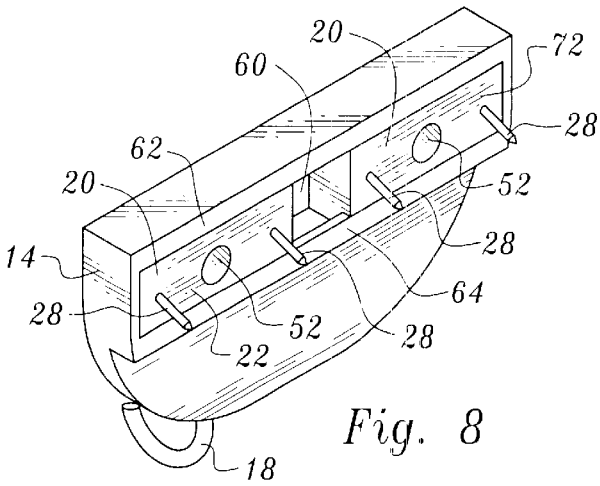
FIG. 8 is a rear view of a cup holder having two support devices connected thereto.
Figure 10:
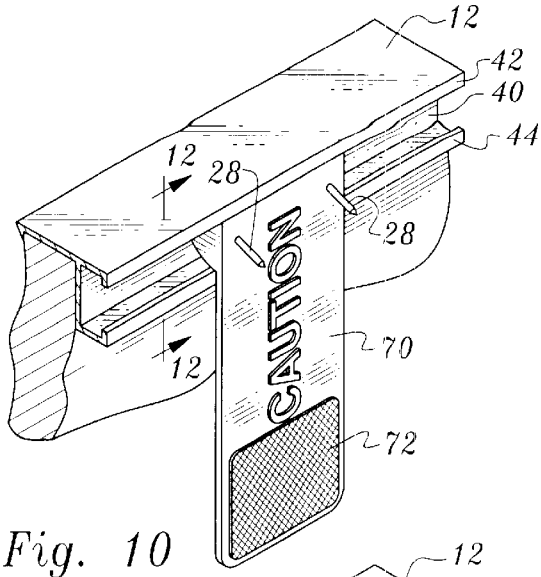
FIG. 10 shows the alternate form of support device installed on a frame.
Figure 11:
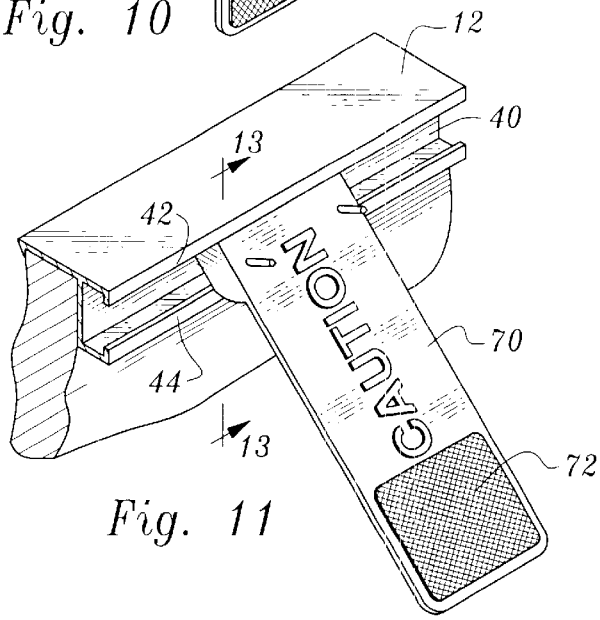
FIG. 11 is a view similar to FIG. 10, but illustrating the support device in the process of being installed or removed relative to the frame.
Figure 9:
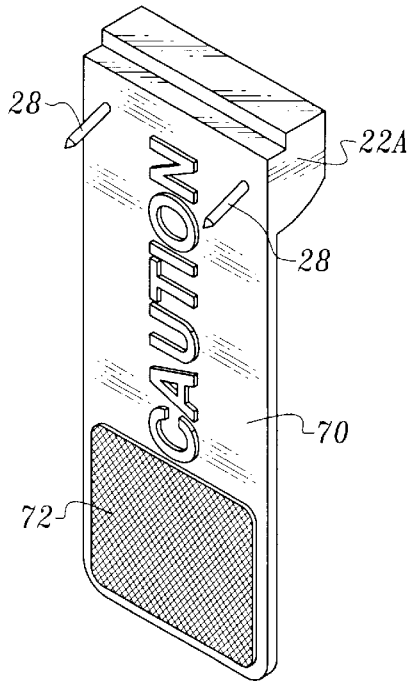
FIG. 9 is a perspective view of an alternative embodiment of the support device.
Figure 12:
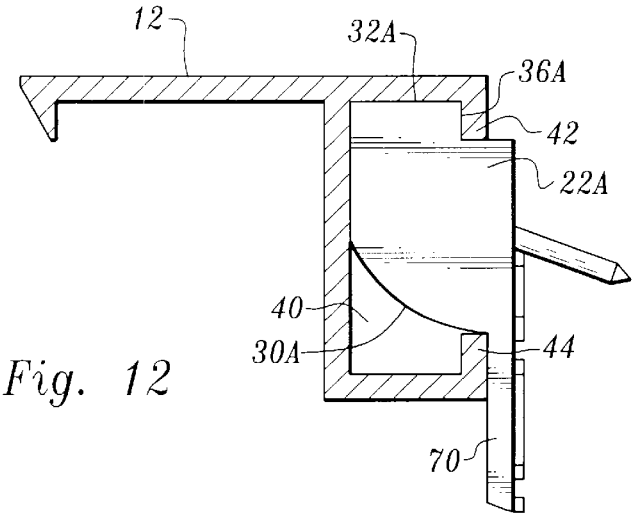
FIG. 12 is an enlarged, cross-sectional view taken along the line 12—12 in FIG. 10.
Figure 13:
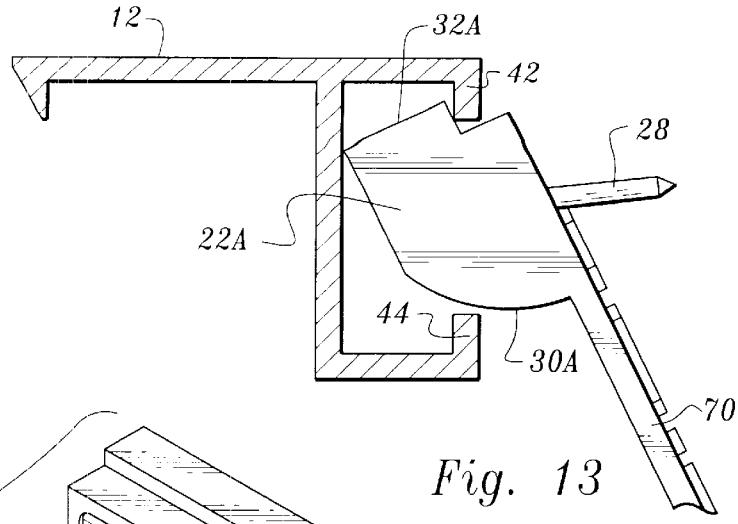
FIG. 13 is an enlarged, cross-sectional view taken along the line 13—13 of FIG. 11.

FIG. 8 illustrates two support devices 20 installed in position in a recess 60 defined by two opposed spaced portions or segments 62, 64 of cup holder 14.

FIGS. 9–13 illustrate another embodiment of the invention wherein a manually graspable member in the form of a tab element 70 is integrally attached to and depends from support member 22A. In this embodiment of the invention, the curved or arcuate object engagement surface 30A is disposed downwardly to engage frame lip 44. The object engagement surface 32A defining indent 36A, on the other hand, is positioned at the top and engages lip 42 of the frame 12.

In this arrangement, the tab element itself is manually grasped to install or remove the support device. There is no need for a separate tool, such as tool 50 described above. If desired, the lower end of the tab element 70 may be roughed as designated by reference numeral 72 to prevent slipping when grasped by the user.

Figure 14:
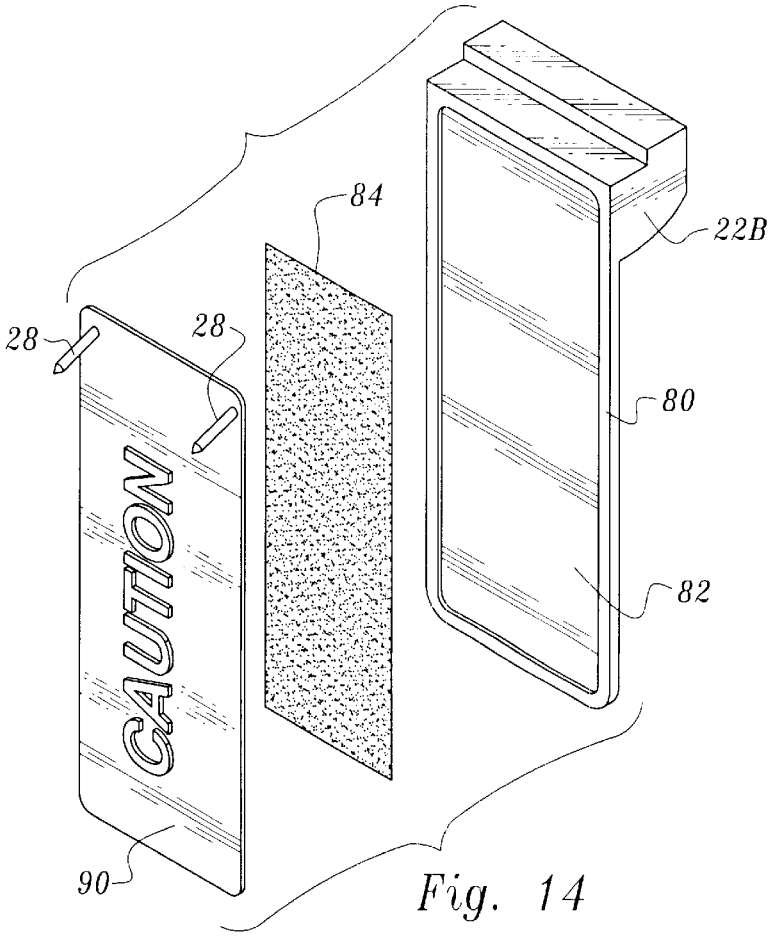
FIG. 14 is an exploded view of another alternative embodiment of the support device.
Figure 15:
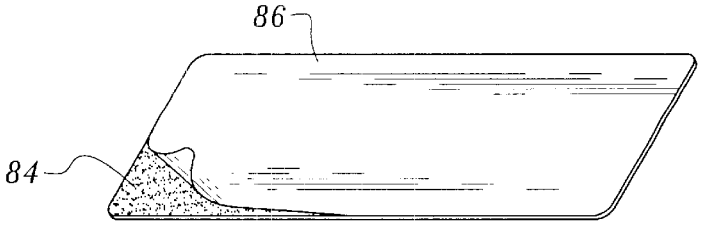
FIG. 15 illustrates an adhesive panel of the embodiment of FIG. 14.

FIGS. 14 and 15 illustrate another embodiment of the invention. In this embodiment, support member 22B has a tab element segment 80 integrally attached thereto. Tab element segment 80 has an area of reduced width 82 which accommodates therein a panel 84 which is adhesively secured to the tab element segment 80.

The outer face of the panel or sheet 84 is coated with an adhesive which is protected by a cover sheet 86 until use is desired. This embodiment of the invention can be attached to a wall in two different ways. The tab element segment 80 and support member 22B may simply be attached to a wall by the adhesive on panel 84, the cover sheet 86 having been removed therefrom just prior to use. Alternatively, the tab element segment 90 having pin members 28 affixed thereto may be adhesively secured by panel 84 to tab element segment 80. The pin members are then utilized as discussed above to support the device from a wall.

The invention claimed is:

1. A support device for supporting an object from a structure, said support device comprising a support member having a front support member surface and a rear support member surface, said rear support member surface for positioning in face-to-face relationship with the structure, and at least one pin member connected to said support member for piercing and entering the structure projecting rearwardly from said rear support member surface for maintaining the rear support member surface in face-to-face relationship with the structure and for maintaining the support member at a desired location on the structure, said at least one pin member being inclined downwardly and defining an acute angle with the rear support member surface, said support member additionally having opposed top and bottom object engagement surfaces extending between said front support member surface and said rear support member surface, one of said top and bottom object engagement surfaces being an arcuate surface diverging away from the other of said top and bottom engagement surfaces in a direction extending from said front support member surface toward said rear support member surface and the other of said top and bottom object engagement surfaces defining an object retention indent extending the length of said support member and adjoining said rear support member surface, said support member for entering a recess defined by two spaced portions of the object and for releasable retention in said recess due to frictional engagement between said support member and said two spaced portions, said support member being dimensioned such that said top and bottom object engagement surfaces will be in tight frictional engagement with said two spaced portions of the object after entering the recess thereof with one of the spaced portions of the object in said object retention indent and the other of the spaced portions of the object engaging said arcuate surface.

2. The support device according to claim 1 wherein said object is a picture frame and wherein said recess is located in the back of said frame and defined by two spaced frame portions, said object engagement surfaces comprising frame engagement surfaces, said object retention indent for receiving one of said frame portions and said arcuate surface for tight frictional engagement with the other of said frame portions.

3. The support device according to claim 1 additionally comprising a manually graspable member projecting from said support member for manipulating said support member.

4. The support device according to claim 3 wherein said support member defines an opening, said manually graspable member comprising a tool having a tool end located in said support member.

5. The support device according to claim 3 wherein said manually graspable member comprises a tab element integral with said support member.

6. The support device according to claim 1 wherein a plurality of pin members are connected to said support member, said pin members being spaced from one another.

7. In combination:

a support device for supporting an object from a structure, said support device comprising a support member having a front support member surface and a rear support member surface, said rear support member surface for positioning in face-to-face relationship with the structure, and at least one pin member connected to said support member for piercing and entering the structure projecting rearwardly from said rear support member surface for maintaining the rear support member surface in face-to-face relationship with the structure and for maintaining the support member at a desired location on the structure, said at least one pin member being inclined downwardly and defining an acute angle with the rear support member surface, said support member additionally having opposed top and bottom object engagement surfaces extending between said front support member surface and said rear support member surface, one of said top and bottom object engagement surfaces being an arcuate surface diverging away from the other of said top and bottom engagement surfaces in a direction extending from said front support member surface toward said rear support member surface and the other of said top and bottom object engagement surfaces defining an object retention indent extending the length of said support member and adjoining said rear support member surface; and an object having two spaced portions defining a recess, said support member being disposed in said recess and in frictional engagement with said two spaced portions to releasably retain said support member in said recess with said at least one pin member projecting therefrom, said support member being dimensioned such that said top and bottom object engagement surfaces are in tight frictional engagement with said two spaced portions of the object and one of the spaced portions of the object being in said object retention indent and the other of the spaced portions of the object engaging said arcuate surface.

8. A support device for supporting an object from a structure, said support device comprising a support member having a front support member surface and a rear support member surface, said rear support member surface for positioning in face-to-face relationship with the structure, and at least one pin member connected to said support member for piercing and entering the structure projecting rearwardly from said rear support member surface for maintaining the rear support member surface in face-to-face relationship with the structure and for maintaining the support member at a desired location on the structure, said at least one pin member being inclined downwardly and defining an acute angle with the rear support member surface, said support member additionally having a pair of opposed object engagement surfaces extending between said front support member surface and said rear support member surface, one of said object engagement surfaces being an arcuate surface and the other of said object engagement surfaces defining an indent extending the length of said support member, said support device additionally comprising a manually graspable member projecting from said support member for manipulating said support member, said manually graspable member comprising a tab element integral with said support member, said tab element comprising two tab element segments connected together in face-to-face relationship, the at least one pin member attached to and projecting outwardly from one of said tab element segments.

9. A support device for supporting an object from a structure, said support device comprising a support member having a front support member surface and a rear support member surface, said rear support member surface for positioning in face-to-face relationship with the structure, and at least one pin member connected to said support member for piercing and entering the structure for maintaining the rear support member surface in face-to-face relationship with the structure and for maintaining the support member at a desired location on the structure, said at least one pin member being inclined downwardly and defining an acute angle with the rear support member surface, said support member additionally having a pair of opposed object engagement surfaces being an arcuate surface and the other of said object engagement surfaces defining an indent extending the length of said support member said support device additionally comprising a manually graspable member projecting from said support member for manipulating said support member, said manually graspable member comprising a tab element integral with said support member, and adhesive on a side of said tab element spaced from said support member.

* * * * *